US010123581B2

(12) United States Patent
Lacy et al.

(10) Patent No.: US 10,123,581 B2
(45) Date of Patent: Nov. 13, 2018

(54) EYEWEAR RETAINER

(71) Applicant: SUNDAY AFTERNOONS, INC., Talent, OR (US)

(72) Inventors: Robbin Lacy, Talent, OR (US); Russell Hodgdon, Talent, OR (US); Gulnara Iskhakova, Talent, OR (US)

(73) Assignee: Sunday Afternoons, Inc., Talent, OR (US)

( * ) Notice: Subject to any disclaimer, the term of this patent is extended or adjusted under 35 U.S.C. 154(b) by 0 days.

(21) Appl. No.: 14/809,055

(22) Filed: Jul. 24, 2015

(65) Prior Publication Data

US 2016/0021962 A1 Jan. 28, 2016

Related U.S. Application Data

(60) Provisional application No. 62/028,772, filed on Jul. 24, 2014.

(51) Int. Cl.

| | |
|---|---|
| ***A42C 5/00*** | (2006.01) |
| ***A42B 1/20*** | (2006.01) |
| ***A42B 1/22*** | (2006.01) |
| ***A42B 1/24*** | (2006.01) |
| ***A42B 1/06*** | (2006.01) |

(52) U.S. Cl.

CPC ..... *A42B 1/201* (2013.01); *A42B 1/063* (2013.01); *A42B 1/22* (2013.01); *A42B 1/247* (2013.01)

(58) Field of Classification Search

CPC ..... A42B 1/247; A42B 1/22; A42B 1/201; A42B 1/063

USPC ..... 2/10, 417, 195.2; 351/155

See application file for complete search history.

(56) References Cited

U.S. PATENT DOCUMENTS

| | | | | | |
|---|---|---|---|---|---|
| 1,947,480 | A * | 2/1934 | Meyer | A42B 1/22 | 2/195.2 |
| 5,048,160 | A * | 9/1991 | Goodrich | A41H 37/001 | 24/114.6 |
| 5,121,507 | A * | 6/1992 | Brown | A42B 1/004 | 2/10 |
| 5,604,960 | A * | 2/1997 | Good | A41F 1/002 | 24/303 |
| 5,632,046 | A * | 5/1997 | Green | A42B 1/22 | 2/175.1 |
| 5,948,707 | A * | 9/1999 | Crawley | A41D 31/02 | 428/422 |
| 6,237,159 | B1 | 5/2001 | Martin | | |
| 6,298,495 | B1 | 10/2001 | Totani | | |
| 6,671,885 | B2 | 1/2004 | Viggiano | | |
| 7,140,047 | B2 * | 11/2006 | Kronenberger | A42B 1/24 | 2/209.13 |
| 7,979,921 | B2 * | 7/2011 | Cotutsca | A42B 1/247 | 2/209.13 |
| 8,740,379 | B2 | 6/2014 | Berger | | |

(Continued)

*Primary Examiner* — Nathan Durham
*Assistant Examiner* — Abby Spatz
(74) *Attorney, Agent, or Firm* — McCoy Russell LLP

(57) ABSTRACT

Embodiments are disclosed for headwear including an eyewear retaining pocket. For example, the headwear may include a headwear body including a crown, a hat brim extending from the crown, and one or more slits disposed on a side panel of the crown, each slit providing access to a pocket formed in the side panel of the crown, the pocket including one or more strips of a retaining material coupled to an inner surface of the pocket.

14 Claims, 13 Drawing Sheets

(56) References Cited

U.S. PATENT DOCUMENTS

| | | | | |
|---|---|---|---|---|
| 2006/0048277 | A1* | 3/2006 | Yeadon | A42B 1/041 2/204 |
| 2006/0152671 | A1* | 7/2006 | Risso | A42B 1/247 351/155 |
| 2015/0351478 | A1* | 12/2015 | Yurevich | A42B 1/247 2/209.13 |

* cited by examiner

EYEWEAR RETAINER

CROSS-REFERENCE TO RELATED APPLICATIONS

The present application claims priority to U.S. Provisional Patent Application No. 62/028,772 entitled "FORAGE HAT," filed Jul. 24, 2014, the entire contents of which are hereby incorporated by reference for all purposes.

FIELD

The disclosure relates to a hat including an eyewear retainer.

BACKGROUND

Headwear may be utilized to shield a wearer from environmental hazards, such as sunlight, debris, rain, etc. A wearer may also perform various activities while wearing headwear. During some conditions and/or activities, a wearer may stow eyewear, such as eyeglasses or sunglasses away temporarily. In order to allow quick retrieval of the stowed eyewear, some hats provide openings to accept earpieces of eyewear. For example, U.S. Pat. No. 6,671,885 (Viggiano) discloses slots in a side of a crown of a hat that allow for insertion of earpieces of eyewear. However, while performing activities, such as moving his/her head around or down, a wearer may easily dislodge eyewear stowed in such openings.

For example, the inventors have recognized some disadvantages with the eyewear retainers of Viggiano. In Viggiano, attempts to secure the eyewear are made by lining the openings with a hook and loop material. However, in order to provide the intended security, the wearer would continually adjust the openings by detaching opposing segments of the hook and loop material to one another to accept the eyewear, then reattaching opposing segments of the hook and loop material to one another around the earpieces of the eyewear. Furthermore, the hook and loop material itself does not have any adhesive quality with respect to the surface of the earpieces, but rather merely creates a smaller pocket for the earpieces. Further still, the large area of hook and loop material provided in the hat of Viggiano would create a dense region of additional material along the crown of the hat, affecting aesthetics, airflow, and flexibility/comfort of the hat.

SUMMARY

The disclosure provides embodiments of an eyewear retainer that mitigate the above-described issues. For example, headwear according to the following disclosure may include a headwear body including a crown, a hat brim extending from the crown, and one or more slits disposed on a side panel of the crown, each slit providing access to a pocket formed in the side panel of the crown, the pocket including one or more strips of a retaining material coupled to an inner surface of the pocket. By providing a lining for an eyewear retaining pocket as described herein, the disclosed embodiments enable eyewear to be inserted, secured, and removed without adjustment of the retainer by the user. The disclosed striping of retaining material in the pocket also promotes air flow through the pocket to help cool a wearer and retains flexibility and comfort of the hat. Further features of eyewear retainer embodiments are described below.

BRIEF DESCRIPTION OF THE DRAWINGS

The disclosure may be better understood from reading the following description of non-limiting embodiments, with reference to the attached drawings, wherein below.

DETAILED DESCRIPTION

Figure 1:
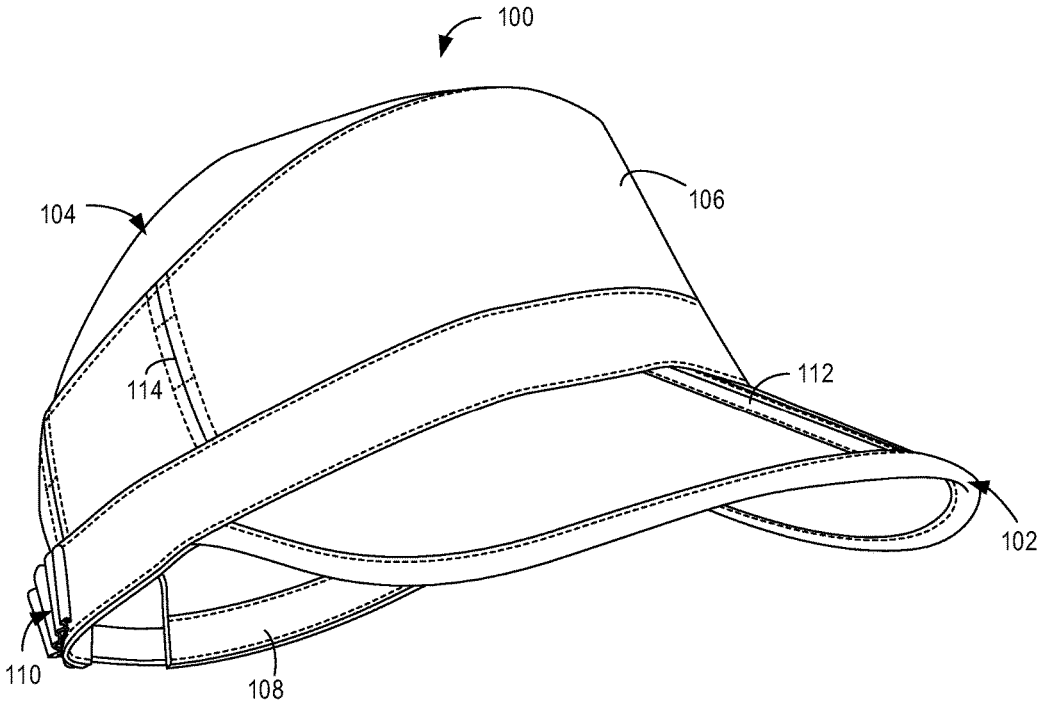
FIG. 1 shows a front isometric view of example headwear in accordance with one or more embodiments of the present disclosure.

An updated Sunglass Lock technology is included in the disclosed headwear, which may provide the dual functionality of increased security during eyewear storage and increased airflow to a wearer's head. For example, an interior of a pocket and/or channel formed in a side of the headwear may have an internal side (e.g., closest to a wearer's head) that provides ventilation to the wearer's head via ventilating material of a sweatband. The interior of the pocket and/or channel may also have an external side (e.g., closest to an outer environment of the headwear, farther from the head of the wearer than the internal side) that includes one or more strips of retaining material (e.g., silicone in one non-limiting example) to assist in gripping eyewear within the interior of the pocket and/or channel. Therefore, when an earpiece of eyewear is inserted into the pocket/channel, the strips may be positioned on one side of the earpiece and the ventilation material of the sweatband may be positioned on an opposite side of the earpiece. In this way, one side of the pocket/channel may provide retention features, while the opposite side of the pocket/channel may provide ventilation access for increased air flow to a wearer's head. The eyewear retainer may utilize various venting slit sizes/segmentations and possible liners to make the eyewear "lock" in even more securely. Additional features of an eyewear retainer and/or associated slip stream venting are described and illustrated in more detail below with respect to FIGS. 7A-8D.

A completely new sizing system, described and illustrated in more detail below with respect to FIGS. 3 and 4, included in the headwear utilizes no moving parts, and may be made of material with more durability than plastics that might fail in the field in some embodiments. For example, a sizing buckle may be stepped on in the field, and the brittle materials of said sizing buckle may result in breakage of the buckle, removing the ability to adjust the size of the hat. Such malfunctioning gear in the field becomes a liability. By removing the moving parts and brittle materials used in some sizing mechanisms, the present disclosure provides a more robust sizing mechanism that may be reliably used in even the toughest environments.

The example headwear provided in this disclosure may provide a silhouette that is similar to an early $20^{th}$ century German or Russian Forager Cap and may include a unique technical twist with a plurality of technical features, as well as a flexible application of trims and fabrics. For example, the headwear may be configured with a material composition that is effective for providing camouflage, blocking UV rays, transferring heat away from the head, resisting and/or repelling water, etc. Structural supports may be embedded in various regions of the headwear to provide additional support of a biased shape of the headwear.

A tactical wearer of headwear may frequent locations such as a shooting range and wear a traditional cadet/patrol style hat. Such hats traditionally have a high front panel that carries around the entire circumference. The present disclosure provides headwear that maintains the traditional military style look in the front with a lower profile appearance in the back. Wearing shooting ear muffs (ear pro) all day may make more traditional military-style hats bunch up on the sides and may generally be uncomfortable for extended use. The present disclosure provides headwear with a crown pattern that may include a one piece pattern with specifically curved darts to match the natural curvature of a wearer's head in the rear. The pattern differs from ball caps (traditional 6 and 5 panel caps) as well as performance hats (rounded in the front and rear). The hat offers the wearer the traditional military style silhouette with the comfort of a ball cap along with the convenience of stowing sunglasses (eye pro) in a secure sunglass lock system and features an unbreakable sizing system on the rear. It is to be understood that the silhouette described above provides just one example of headwear that may include the various features described in this disclosure, and one or more of the features may be interchangeable and/or included on various styles of headwear.

These and other features (described in more detail below) may be provided in various combinations of headwear embodiments to provide a robust, flexible, and functional cap that performs well in any environment and stands up to heavy use. Although illustrated and described as a cap, it is to be understood that any one or more of the features described herein may be included in any suitable style of hat, including, without limitation, a charter hat, a sun fedora, a boonie hat, a capotain, a gat, a hardee hat, a homburg, a panama, a sombrero, a sun visor, a top hat, a legionnaire hat, a flap hat, and/or any other suitable head covering.

FIG. 1 shows a front isometric view of an example headwear 100. Headwear 100 may include a foldable brim 102 (e.g., a visor) extending from or otherwise carried by a hat body 104. Hat body 104 may include a multi-paneled crown in some embodiments, while in other embodiments the hat body may be formed of a single panel or piece of fabric (e.g., a unibody construction) forming any suitable hat body shape. The crown may comprise a cap configured to extend over a top of a wearer's head. In some embodiments, the crown may include a plurality of panels extending around a circumference or perimeter of the crown and intersecting at a central region (e.g., attaching to a top panel of the crown). In some embodiments, the crown may not include a cap. For example, a cap may be defined as a covering over the top of a wearer's head (e.g., providing material in all areas of the crown). A crown without a cap may include a crown that does not cover all of a wearer's head within the crown. A visor is an example of a hat including a crown without a cap, as a visor may allow a wearer's head to remain exposed to the environment while wearing the hat.

In the illustrated example, a front panel 106 may be of a generally rectangular shape (e.g., with parallel substantially straight vertical sides, a substantially straight bottom side that curves around a circumference of the crown of the hat, and a top side that curves/extends upward) curved around the circumference of the hat body. In some embodiments, each panel (or the entirety of the hat body/brim) may include the same type of fabric or other material. In other embodiments, one or more panels (or the hat brim) may include a different type of material than the other panels.

Figure 6:
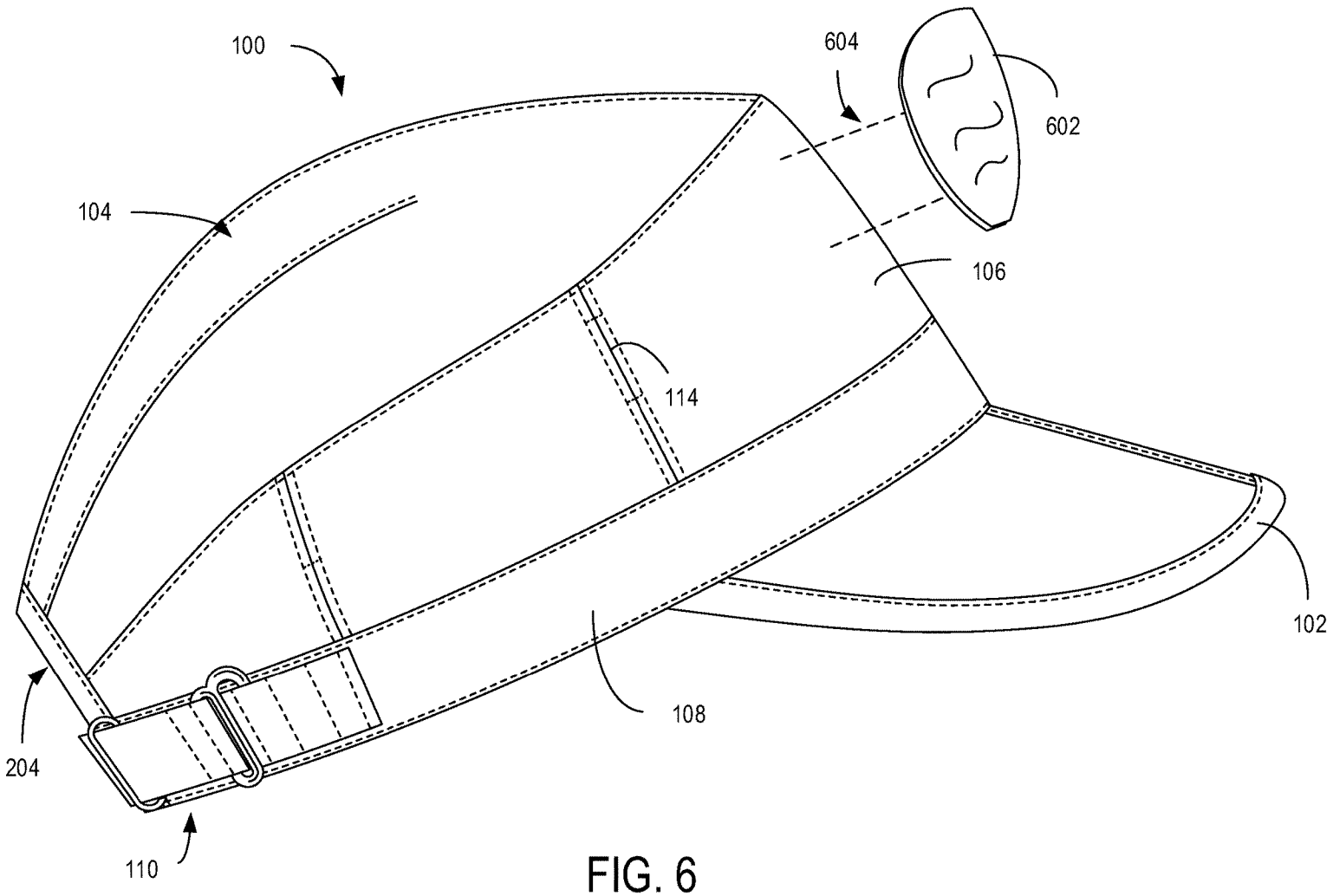
FIG. 6 shows an example right side view of example headwear in accordance with one or more embodiments of the present disclosure.

For example, as illustrated in FIG. 1, the front panel 106 may be formed of felt or other loop or hook type of fabric, enabling objects to be secured to the panel (e.g., via a hook/loop fastening) as shown in more detail in FIG. 6. Such fabric may be used as the front panel (e.g., with no other material positioning in that location) or may be attached to one or more under layers of material (e.g., material matching the remaining panels of the hat, mesh lining, etc.). The front panel 106 and/or the outer material of front panel 106 may be secured to the surrounding panels via stitching along each side of the panel or by any other suitable securing mechanism. Front panel 106 may be symmetric along an axis formed approximately in the center of the foldable brim 102.

Headband 108 may form another panel of the hat body and/or a junction between the hat body and the foldable brim 102. Headband 108 may extend around the circumference of the base of the hat body and house the sizing mechanism 110 described in more detail below with respect to FIGS. 3 and 4. In some embodiments, the headband 108 may extend around the entire circumference of the hat body (e.g., formed from a single, continuous loop of material) and/or may extend partly around the circumference (e.g., leaving an opening in the back of the hat body). For example, headband 108 may be formed from a substantially rectangular panel that includes terminating ends that are spaced from one another. The size of the hat may be adjusted by pulling the terminating ends closer to one another (or farther apart) using sizing mechanism 110.

One or more additional panels may form the remainder of hat body 104. The panels may be configured to provide a head-mapping contour, allowing for a low-profile fit. For example, front panel 106 may include the highest point of the hat body, and the panels along the side and top of the hat may converge toward one another as the panels extend to the rear of the hat. This head-mapping crown feature will be described in more detail below with respect to FIG. 2.

Foldable brim 102 may be configured to fold inward, such that the outer edges of the brim converge toward one another in a downward direction (when the hat is oriented as illustrated in FIG. 1) when folded. The folding operation may be facilitated by a slit 112 formed in the generally rigid or semi-rigid material of the brim substrate. The brim may be formed of one or more layers of brim substrate covered in one or more outer layers of fabric (or other flexible material), the brim substrate being more rigid than the outer layers of fabric. For example, one or more portions of the brim (e.g., the brim substrate) may include pre-curved polymer material (e.g., 1.5 mm thick) that can be biased to retain a particular shape and have a density that enables floatation in water. In some embodiments, the material under the brim substrate (e.g., facing a wearer's face) may be different than the material above the brim substrate (e.g., facing away from the wearer).

In order to provide more robust folding operation, slit 112 may be reinforced by self-fabric exterior bias material (e.g., bias material that is the same as the outer material of the brim). The slit may be reinforced at an associated seam with grosgrain or another suitable material to keep out debris and add lateral strength. For example, a piece of fabric may be folded over each edge of the slit. The additional reinforcement described above may be provided by attaching a piece of material to the underside of each seam (e.g., under the edges of each side of the slit), the material stretching between the edges of the slit. Accordingly, when folded, the piece of reinforcement material under the slit may be exposed, rather than a brim substrate or other element. The material under the slit may be formed of the same material and/or have the same pattern as the material on the upper side of the brim in some examples in order to provide a seamless transition between the brim and the reinforced slit opening.

Headwear 100 may include one or more pairs of optics (e.g., sunglasses/glasses) holders 114 along the side of the hat body 104. For example, a slit may be present in each of the side panels of the hat body providing access to one or more pockets formed in the panels. As used herein, it is to be understood that a pocket may be formed of two or more materials coupled together in a manner that enables elements to be inserted therein. For example, earpieces/legs of the frames of the optics may be inserted into the pockets as illustrated and described in more detail below with respect to FIGS. 7 and 8. Accordingly, a pocket, as used herein, may encompass a channel formed between two or more materials (e.g., two or more materials layered on top of one another and joined along two opposing edges to form an opening therebetween with at least two entrances to the channel), a partially-enclosed pocket (e.g., two or more material layered on top of one another and joined along at least three edges to form an opening therebetween with only one entrance to the pocket, the pocket being segregated from other material and/or closed at both or either end), and/or any suitable variation thereof. It is to be understood that joining or coupling, as used throughout the disclosure, may refer to any suitable coupling mechanism, including but not limited to attaching, stitching, gluing, adhering, chemical bonding, sewing, etc. Particular coupling mechanisms may be performed to provide advantages relating to that coupling mechanism, and disclosure of a particular coupling mechanism to join two or more elements together may be understood to also cover the disclosure of any other suitable coupling mechanism to join those two or more elements together.

Figure 2:
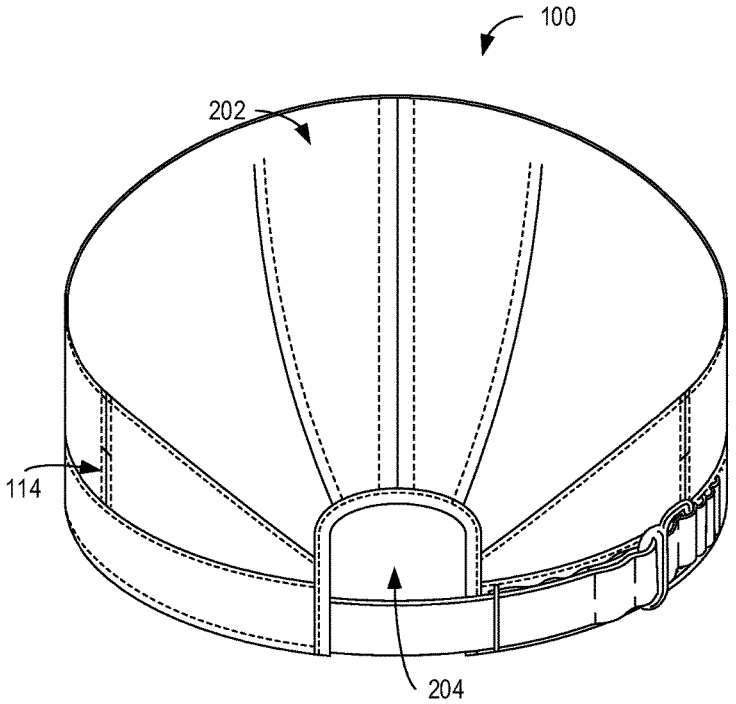
FIG. 2 shows a rear view of example headwear in accordance with one or more embodiments of the present disclosure.

In some examples, headwear may provide a different silhouette from the illustrated silhouette while maintaining the same core features (e.g., sunglasses holders 114, sizing mechanism 110, head-mapping crown as shown in FIG. 2, etc.). For example, the silhouette of such headwear may provide a more cylindrical hat body than the illustrated headwear 100, as opposed to the head-mapping contour of the domed hat body of headwear 100. In this way, the hat body of an alternative example headwear may include a front, side, and rear region each having substantially similar height to one another and a substantially rectangular two dimensional projection.

FIG. 2 shows a rear view of headwear 100 illustrated in FIG. 1. FIG. 2 illustrates the contoured appearance of the head-mapping crown for headwear 100. Panels 202 may be formed of different pieces of material sewn together (or otherwise attached) and/or by altering the material (e.g., sewing darts). For example, multiple panels may be formed from one continuous piece of material by providing one or more darts in the piece of material, creating multiple seams to form the edges of the panels. Each panel may be wider at a front end of the cap (e.g., toward the brim) and narrower toward a rear of the cap (e.g., toward the opening and sizing mechanism of the cap). The panels may terminate toward the front of the cap at a front and/or side panel, and may terminate toward the rear of the cap at an opening 204. For example, a side panel of the cap may have a non-rectangular shape that tapers inward toward a rear opening in a back of the cap.

The shaping of the head-mapping crown may be formed based on anatomical structures of a head of a wearer (e.g., based on average measurements and/or configurable in different measurements for different sizes of headwear). For example, darts, stitching, and/or panel measurements may be matched to regions of a skull of a wearer. As an additional or alternative example, a central seam may be aligned with a central region of a skull or head of a wearer, and darts/seams may be positioned to be aligned with one or more side regions of a skull or head of a wearer. Opening 204 may be made larger or smaller by adjusting the sizing mechanism. Side edges of the panels 202 may be formed by darts, stitching, or other folding/attachment structures. It is to be understood that the head-mapping crown may be utilized in any other suitable headwear than those illustrated. For example, a full-brim hat (and/or a hat with a larger brim that that illustrated in FIG. 1) may include a crown having head-mapping contours as described herein.

Figure 3:
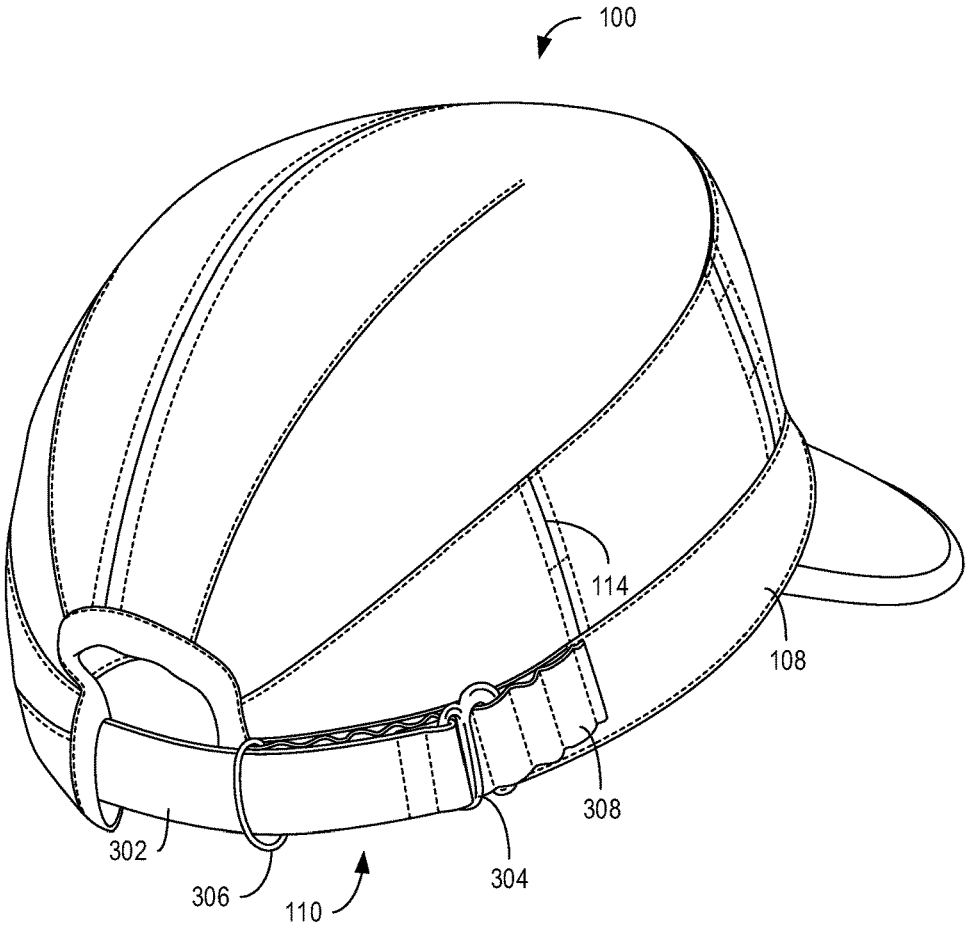
FIG. 3 shows a rear isometric view of example headwear in accordance with one or more embodiments of the present disclosure.
Figure 4:
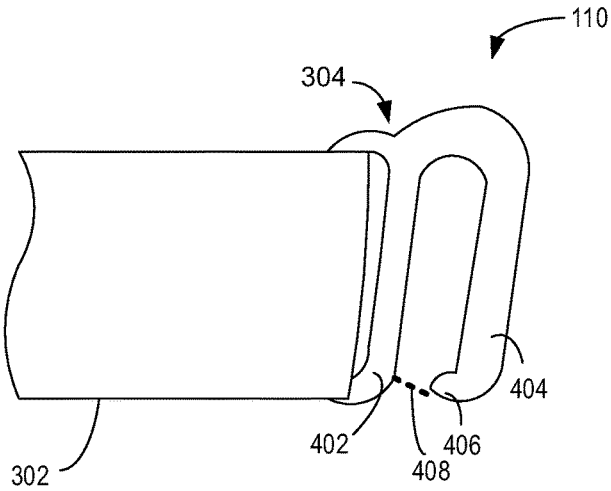
FIG. 4 shows an example detail view of a size adjustment mechanism in accordance with one or more embodiments of the present disclosure.

FIGS. 3 and 4 provide detailed views of sizing mechanism 110 of FIG. 1. Sizing mechanism 110 may be provided to enable the headwear to be size adjustable and conform to a variety of head sizes and types. As illustrated, sizing mechanism 110 includes a strap 302 extending from an inner region of the cap to an outer region of the cap along a circumference of the hat body when disposed in a locked position. For example, strap 302 may be housed and secured to the cap within a pocket formed in headband 108 (e.g., sandwiched between at least two layers of material) at a first end and attached to a sizing clip 304 at a second end, opposite from the first end. In other embodiments, the strap may be attached to an interior of the cap (e.g., exposed to a wearer when placed on the head of the wearer and not within a pocket of material) or an exterior of the cap at the first end. Strap 302 may include and/or be composed of flexible material, such as an elastic polymer, in order to provide a resilient tightening mechanism. In one example, strap 302 may include sizing tape including webbing with elastic extension (e.g., ¾" elastic).

A guiding loop 306 may be attached to an outer region of the cap near a plurality of looped fasteners 308, also secured to the outer region of the cap. Guiding loop 306 may be formed of flexible material (e.g., material that is more flexible than the material of strap 302 and/or looped fasteners 308) that may stretch to allow the passage of the sizing clip 304 when the strap is directed through the guiding loop toward the looped fasteners. The guiding loop 306 may also provide an anchor to which the sizing clip may be attached for additional size customization. The looped fasteners may be made of the same material as strap 302 or of a different material (e.g., with a different amount of flexibility). For example, the looped fasteners may be formed by attaching a strip of material to a headband of the cap (e.g., sewing vertical stitching) in multiple locations along the strip while the strip is allowed to loosely gather between attachments. The looped fasteners may be any suitable size relative to the sizing clip 304. In some embodiments, each of the looped fasteners may be a same size (e.g., have a same opening area when not stretched and/or have a same width/height). In other embodiments, one or more looped fasteners may be sized differently from one or more other looped fasteners. Although illustrated along a right side of the headwear, it is to be understood that the looped fasteners and other sizing mechanism elements may be located in any suitable region of the cap. For example, the sizing mechanism may be mirror-reversed or have a shifted location from the illustrated example and still fall within the scope of this disclosure.

The sizing clip 304 may be formed of any suitable material. For example, sizing clip 304 may be formed of metal or a metal alloy for strength, plastic for weight reduction, and/or any suitable combination of materials. As a more detailed example, a combination of materials that may be utilized includes the stretch of an elastic overlap stitched to a military grade 20MM webbing, sewn to a nylon coated steel "G" hook that acts as the hook (e.g., sizing clip 304) that latches onto the webbing sizing loops (e.g., 308) on the other side of the rear hat opening. The sizing clip may include a first closed loop that is attached to an associated loop of material from the strap 302 and a second, partially open loop configured to be removably attached to a selected looped fastener 308. The partially open loop may include two substantially parallel prongs (e.g., an innermost prong 402 of FIG. 4 forming a side of the first closed loop and an outermost prong 404 of FIG. 4 spaced from the first closed loop) attached at one end and opened at another such that one of the prongs may pass through a looped fastener. As described above, one of the prongs may be configured to attach to guiding loop 306 in order to provide additional width beyond that supplied by the looped fasteners.

In some embodiments, a hook 406 (illustrated in FIG. 4) along the outermost prong 404 may be provided that is configured to wrap around a lower edge of a selected looped fastener or guiding loop for further securing the sizing clip to the fastener/loop. In other embodiments, the hook may be absent in order to enable the sizing clip to pass through a looped fastener more easily. In some embodiments, a latch or other securing mechanism, represented by dashed line 408 of FIG. 4, may be included on the hook to provide an additional locking mechanism for locking the hook onto a particular looped fastener or onto the guiding loop 306. In additional or alternative embodiments, one or more additional sizing hooks may be including in the sizing mechanism. For example, utilizing a plurality of sizing hooks may enable the snapback force of the elastic strap to be divided across each hook, reducing the overall force on each hook and reducing the possibility that all of the hooks will be pulled from out of the respective loops.

In some embodiments, the opening of the looped material for each looped fastener may be sized to be close to a width of the widest point of the prong of the sizing clip. For example, the loop of the fastener may be sized such that the loop of the fastener stretches during insertion of the prong and snap back to a tight fit once the prong is in a locked position inside of the lopped fastener. Any suitable number of looped fasteners may be provided. A shock cord elastic sizing tape retention loop may be utilized for the looped fasteners and/or the guiding loop.

Figure 5:
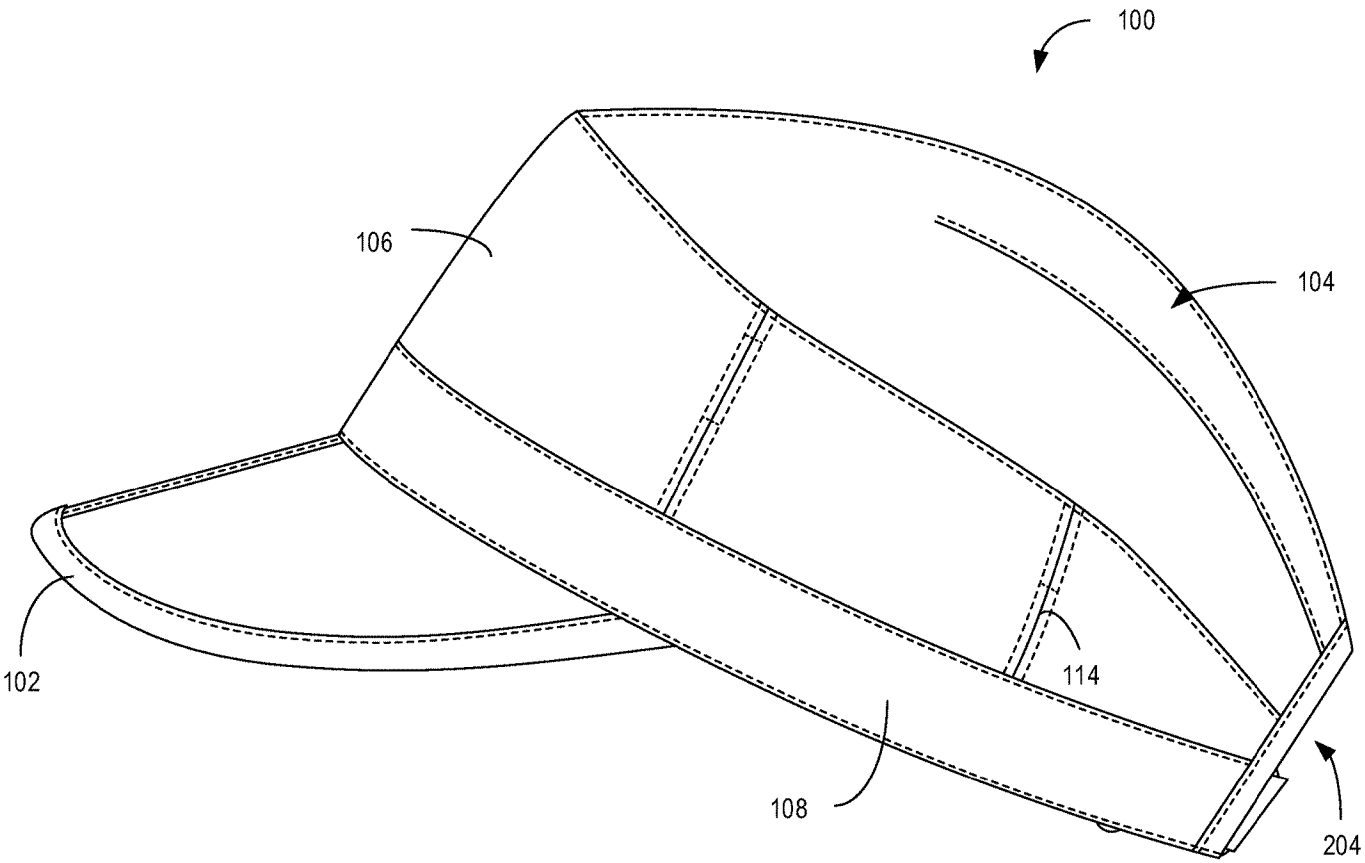
FIG. 5 shows an example left side view of example headwear in accordance with one or more embodiments of the present disclosure.

FIGS. 5 and 6 show side views of headwear 100 of FIG. 1. As illustrated, one or more panels may include curved or otherwise non-uniform edges that may ultimately converge toward a rear of the cap. FIG. 6 further illustrates an exemplary attachment of a badge or other object 602 to a front panel 106. For example, object 602 may include a hook and loop or other attachment mechanism on a rear (e.g., hat-facing) surface that is configured to connect to an associated attachment mechanism on the front panel 106. Dashed lines 604 represent any suitable connection mechanism. For example, object 602 may be sewn, embroidered, glued/adhered, snapped, and/or otherwise attached to front panel 106. Each of the caps illustrated in FIGS. 5 and 6 may include a brim 102 that is biased or angled in a downward direction in order to provide a large amount of protection of the eyes and face of the wearer from debris, sunlight, rain, or other elements.

Figure 7A:
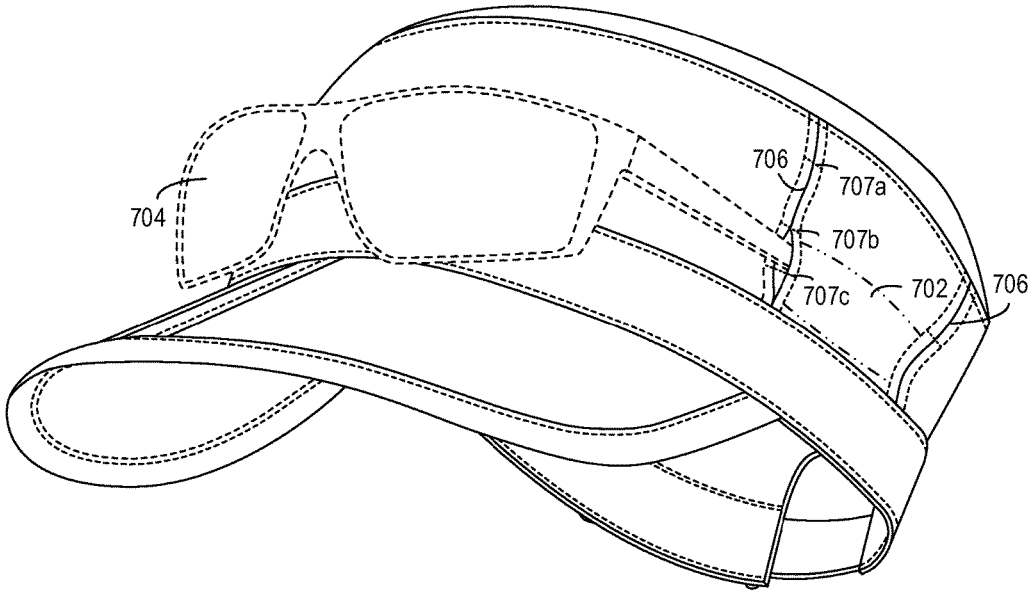
FIG. 7A shows an example headwear with sunglasses secured to a front of the headwear in a respective sunglasses holder in accordance with one or more embodiments of the present disclosure.
Figure 7B:
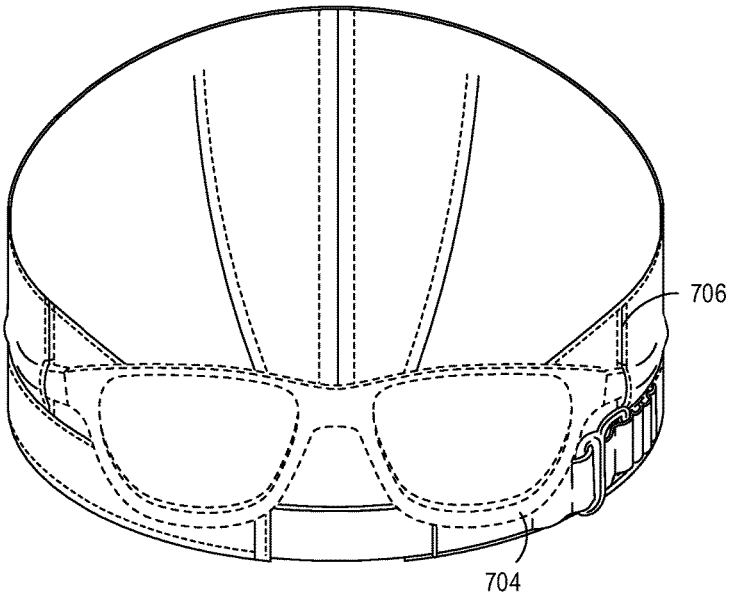
FIG. 7B shows an example headwear with sunglasses secured to a rear of the headwear in a respective sunglasses holder in accordance with one or more embodiments of the present disclosure.

FIGS. 7A and 7B illustrate forward- and backward-facing optics holder poses. In order to secure optics along the front and/or the back of the cap, multiple openings and/or reverse-access openings may be provided in a side panel of the cap. For example, a pocket 702 configured to house a portion of an earpiece or other structure of an optical device 704 (e.g., sunglasses, eyeglasses, reading glasses, safety glasses, goggles, etc.) may be provided within a side panel of the hat (e.g., formed by a gap between at least two layers of material). Although optical devices are described as being inserted into the pocket, it is to be understood that any suitable object may be inserted and retained in the pocket. The pocket may be accessible by one or more slits 706 formed in the side panel. For example, a slit at a front of the pocket (e.g., toward a brim of the cap) may provide access for an earpiece of a forward-facing optic (e.g., as illustrated in FIG. 7A), while a slit at a back of the pocket may provide access for an earpiece of a rear-ward facing optic (e.g., as illustrated in FIG. 7B). Accordingly, four or more slits may be present on the cap to allow access to two or more pockets for holding optics in the above-described embodiments.

In other embodiments, multiple pockets may be included in the side of the cap and a single slit may provide access to each pocket, depending upon the direction at which an object passes through the slit. In such an embodiment, two or more slits may be present on the cap to allow access to four or more pockets. It is to be understood that any number or combination of slits and pockets may be used to secure optics or other objects to the cap. The slit may also may segmented in some embodiments. For example, horizontal stitching forming a dart or tack (e.g., 707*a*, 707*b*, and 707*c*)

may be provided across the slit in one or more locations to create a more secure holding mechanism for the optics when housed in a given pocket. For example, eyewear including curved earpieces may be inserted above at least one dart or tack, and the dart or tack may provide a security mechanism to catch the curved region of the earpieces if the eyewear inadvertently slides out of the pocket. In the illustrated example, if optical device 704 includes curved earpieces, such earpieces may be caught on dart or tack 707*c* upon inadvertent sliding out of the pocket in order to keep the optical device retained until the wearer can reinsert the device. The segmentation of the slits may also provide differently sized openings for differently sized optics. Furthermore, the segmentation of the slits may enable earpieces or other frame elements to be inserted relatively high on the crown of the hat (e.g., in an upper-most opening, above a horizontal stitch) or relatively low on the crown of the hat (e.g., in a lower-most opening, below a horizontal stitch and the upper-most opening). For example, sunglasses with larger frames/lenses may be inserted into an uppermost opening of the slit in order to allow the bottom of the sunglasses lenses/frames to rest on the brim of the hat. The darts or tacks 707*a*-707*c* may be any suitable size capable of extending across the slit 706. For example, the darts or tacks may be approximately ¼ inch long. As illustrated in FIG. 7, optics 704 may be able to rest on the brim when inserted into a lower opening of the slit 706 below the horizontal stitching 707*b*.

Material may be inserted into the slits 706 and/or around the opening/edges of the slits 706 to further prevent and/or promote movement of the optics out of/into the pockets. For example, material having a relatively more adhesive quality (e.g., rubber, texturized material for gripping, silicone, rough fabric, etc.) may be utilized within a pocket and/or along an interior of the edges of openings of the slits 706 to help retain inserted optics within the pocket. Material having a relatively less adhesive or slicker quality (e.g., metal, leather, smooth plastic/fabric, etc.) may be provided along edges of the slits and/or an outer region of the slits in order to promote insertion of optics into the slits/pocket and/or guide the optics into the slits/pocket.

One or more of the slits used for accessing an optics holder may additionally provide ventilation for the cap. For example, the slit may open to a mesh lining of the cap or otherwise provide a path of airflow from an exterior of the cap to an interior of the crown of the cap. Slits 706 may be positioned in any suitable location or configuration on the headwear. For examples, the slits may be positioned higher or lower on the crown, spaced further apart from/closer to one another, shifted along a circumference of the cap, and/or otherwise repositioned relative to the illustrated examples without departing from the scope of this disclosure. Further, it is to be understood that the optics holders described herein may be utilized in any other suitable headwear than those illustrated. For example, a full-brim hat (and/or a hat with a larger brim that that illustrated in FIG. 1) may include one or more of the optics holders described herein.

Figure 8A:
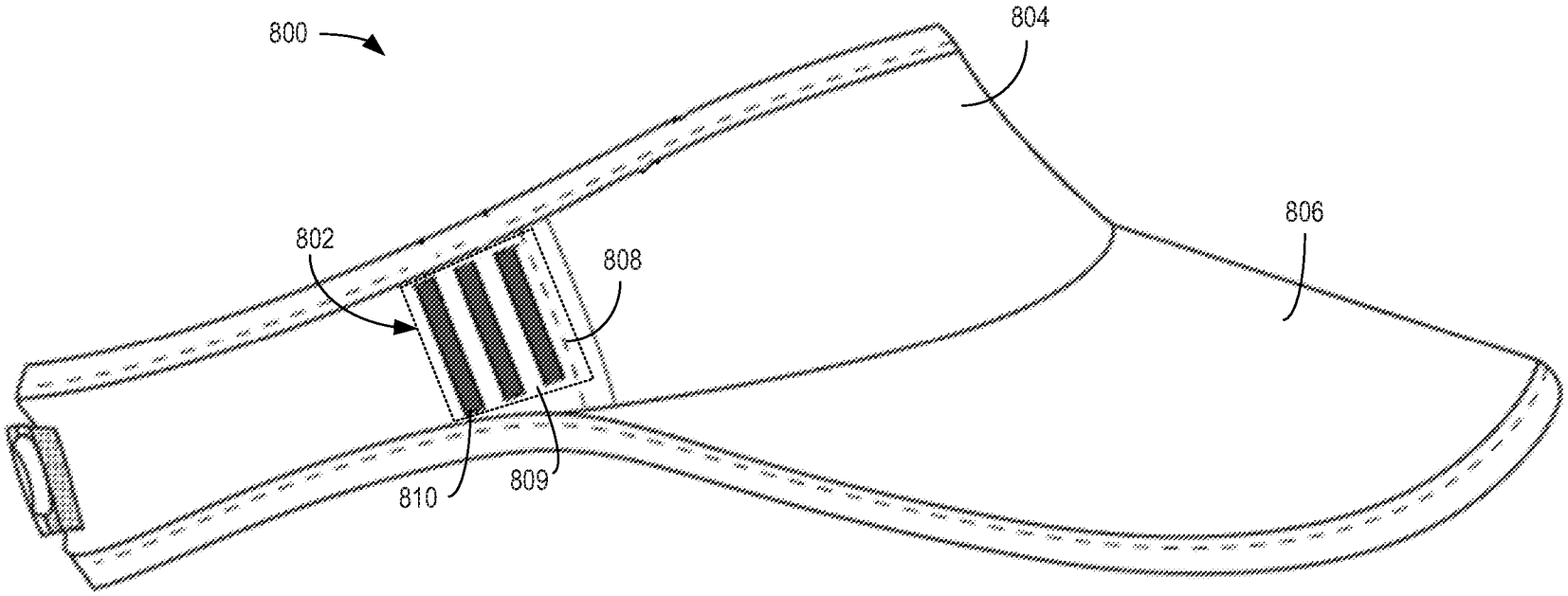
FIG. 8A shows an example interior view of an eyewear retaining pocket in example headwear in accordance with one or more embodiments of the present disclosure.

Examples of an eyewear retaining pocket that also provides for slip stream venting are described in more detail in FIGS. 8A-8D. FIG. 8A shows an example interior view of an eyewear retaining pocket 802 in example headwear 800. Headwear 800 may include a crown 804 and a brim 806 extending from the crown 804. The crown 804 may be largely formed from a sweatband or headband in the illustrated example (e.g., where headwear 800 includes a capless visor). However, it is to be understood that the example embodiments of the eyewear retaining pocket described herein may be included in any suitable location (e.g., a single pocket on each side of a crown, two pockets on each side of the crown, etc.) of any suitable hat (e.g., a baseball style cap, a visor, a full-brimmed hat, an adventure hat, a sun hat, etc.), including but not limited to those illustrated and described herein. For example, retaining pockets with locking features as described herein may be included on baseball style caps to allow wearers to stow eyewear while performing sporting activities without worrying about losing the eyewear.

As illustrated in FIG. 8A, the eyewear retaining pocket 802 may be accessed via a slit or other opening 808 in a side of the crown. In some examples, the crown may be formed of multiple layers of material, and the opening 808 may penetrate at least one layer and allow the eyewear to rest behind the at least one layer and/or be sandwiched between the at least one layer and at least one other layer. The eyewear retaining pocket may include one or more strips 810 of retaining material. The strips may be of any suitable size that is smaller than the width of the pocket (e.g., in a direction extending circumferentially around the crown). An example retaining material includes silicone or a silicone composite. Silicone may be selected to provide comfort via the soft and flexible material, and to have a minimal impact on the outward appearance of the hat. Silicone may also stay tacky in both warm and cold weather, while still allowing eyewear to be removed with a reasonable amount of pulling tension. Silicone provides retention capabilities for a variety of materials that may be utilized in eyewear, such as metal, polymers, etc. Silicone is also resistant to dirt and oil build up and easier to clean than other materials (e.g., hook and loop material, which easily retains dirt and other debris within both the hook and loop portions of the material), and the retention properties of silicone are unaffected by perspiration from a sweatband. Silicone also reduces interference with airflow through the pocket to increase ventilation properties of the slits. However, it is to be understood that any suitable material capable of providing additional friction (e.g., beyond that provided by the material of the crown and/or headband) for assisting in the retaining of eyewear within the pocket may be utilized for hats configured for different types of activities/environments. Although shown as multiple strips having the same material, it is to be further understood that only a single strip may be included in the eyewear retaining pocket or multiple strips, all or some of which being composed of different retaining material, may be included in the pocket.

In the illustrated example of FIG. 8A, the strips 810 may be provided on a rear/interior surface of an outermost layer of the crown 804, such that eyewear may be positioned between the retaining material and an inner layer of the crown (e.g., a layer of the crown closer to the wearer's head than the outermost layer). The illustrated positioning may enable the opening 808 to serve as a vent for the headwear by allowing airflow through the opening to the wearer's head via mesh or other venting material 809 forming the inner layer of the crown. In other examples, the strips 810 of retaining material may be provided on the inner layer of the crown and the venting material 809 may be provided in between the strips to maintain some airflow through to the wearer. In such examples, the eyewear may rest on top of the strips 810 (e.g., with the strips positioned between the eyewear and the inner layer of the crown/the wearer), and an outermost layer of the crown (e.g., positioned on top of the eyewear to form the retaining pocket) may be formed of mesh or other ventilation material in order to further promote airflow through to the wearer's head.

Figure 8B:
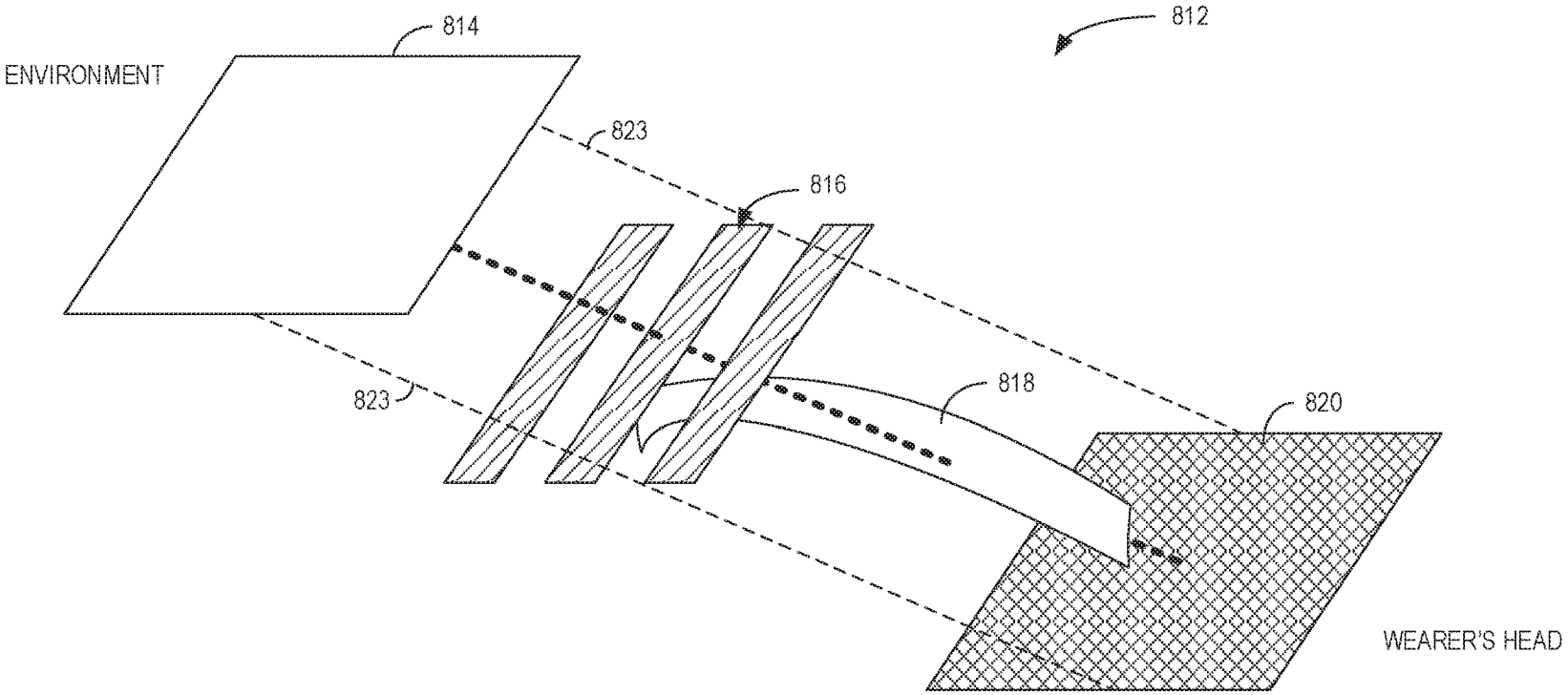
FIG. 8B shows an exploded view of an example eyewear retaining pocket in accordance with one or more embodiments of the present disclosure.

FIG. 8B shows an exploded view of an example eyewear retaining pocket 812. Eyewear retaining pocket 812 may be an example configuration of eyewear retaining pocket 802 of FIG. 8A. As shown in FIG. 8B, an outermost layer 814 of a crown may form an outermost layer of the retaining pocket 812. For example, the outermost layer 814 may be comprised of a material covering a substantial majority of the crown of the headwear, and may include any suitable fabric, leather, suede, elastomer, and/or other material or composite material. In some examples, outermost layer 814 may include a breathable material that allows additional airflow to flow through the pocket 812.

At a second layer, (in order from an environment to a wearer's head), one or more strips 816 of retaining material may be provided. The strips 816 may correspond to the strips 810 of FIG. 8A, and the disclosure provided above with respect to strips 810 may likewise apply to strips 816. Strips 816 may be coupled to an inner surface of outermost layer 814 of the crown by any suitable mechanism, including but not limited to heat transfer, stitching, sewing, embroidering, gluing/adhering, snapping, and/or other adhesive mechanisms. When inserted, an earpiece 818 of eyewear may provide a third layer of the retaining pocket 812. The earpiece 818 may be sandwiched between the strips 816 and a ventilation material 820 (serving as the fourth layer of the pocket when eyewear is inserted, or the third layer when eyewear is not inserted). Ventilation material 820 may form a portion of a headband and/or sweatband of a hat including the retaining pocket 812, and may be composed of a material that allows more airflow through the material than the outermost layer 814 and/or the strips 816. For example, the ventilation material 820 may include mesh, loosely-woven fabric, or another suitable material or composite that allows air to flow through the material. Although the illustrated example provides for ventilation material to serve as the fourth layer of the pocket (e.g., a closest layer to the wearer's head), the retaining pocket may additionally or alternatively be formed using insulating material (e.g., material that retains heat and/or has the same or lower ventilation capabilities to allow the same or less airflow than the outermost layer 814 and/or the strips 816, which may be utilized in a winter hat, for example), material similar to the outermost layer 814, elastomeric material, and/or any other suitable material included in a sweatband/headband and/or layered thereon.

In constructing the pocket 812, the strips 816 may be coupled to the outermost layer 814 (e.g., via heat transfer, sewn, embroidered, glued/adhered, snapped, and/or otherwise attached to the outermost layer). These combined layers may be sewn or otherwise attached to another layer (as represented by dashed lines 823), which may include the ventilation material 820 and/or any other intervening layer not illustrated. The attachment may leave an opening along one edge of the combined layers to allow for insertion of the eyewear therein.

Figure 8C:
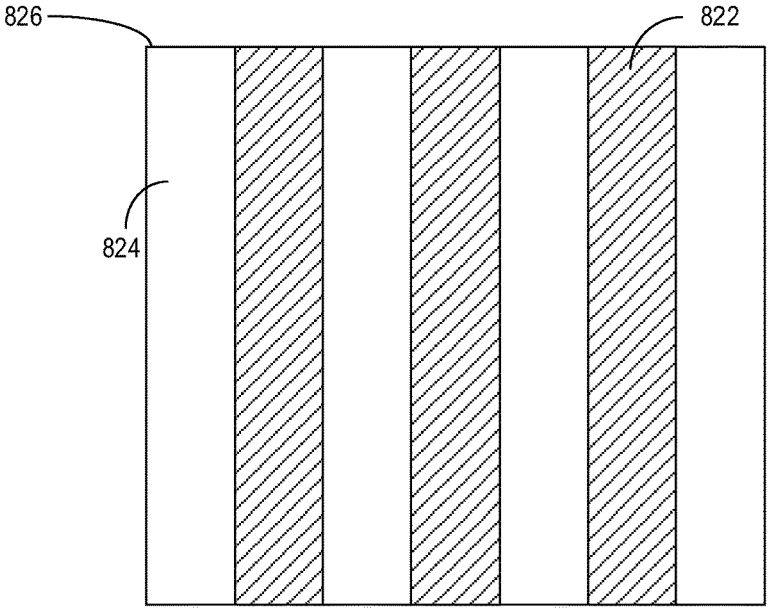
FIGS. 8C and 8D show example arrangements of retaining material in an eyewear retaining pocket in accordance with one or more embodiments of the present disclosure.
Figure 8D:
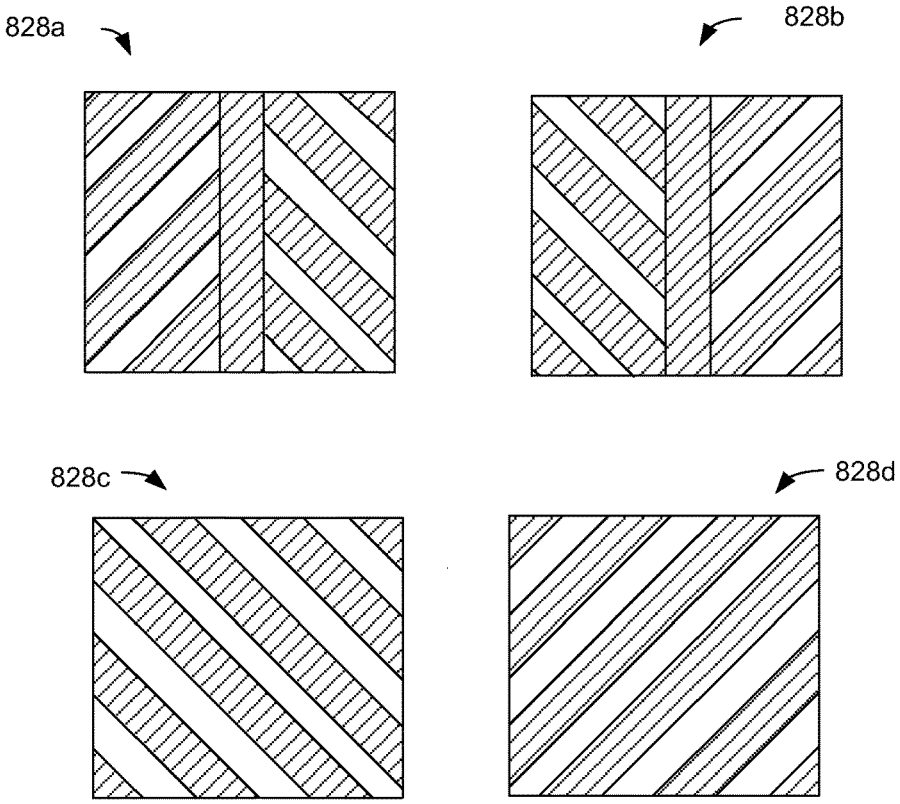

FIGS. 8C and 8D show example arrangements of retaining material 822 in an eyewear retaining pocket as viewed from an interior surface 824 of an outermost layer 826 of a crown. In the example of FIG. 8C, three evenly-spaced strips of the retaining material 822 are provided on the interior surface 824. Each strip may be 4 mm wide and spaced from adjacent strips and/or an edge of the pocket by 4 mm in one non-limiting example. The even spacing may allow for distributed airflow and an ability to fold that portion of the crown to maintain flexibility and comfort. However, it is to be understood that any suitable arrangement of strips may be used to provide other benefits. Additional arrangements are shown in FIG. 8D. For example, arrangements 828*a* and 828*b* show retaining material (illustrated with crosshatching) in diagonal arrangements around a central vertical strip and arrangements 828*c* and 828*d* show uniform angular disposal of the retaining material. Such angularity may promote additional retention for insertion in a plurality of directions. As a horizontal arrangement may not provide sufficient adhesion to the eyewear, the angularity of the strips in arrangements 828*a*-828*d* may vary from approximately +/−80 degrees relative to the vertical arrangement illustrated in FIG. 8A.

For example, as described above, a pocket may be formed such that eyewear may be inserted from a rear and/or a front of the pocket in some examples. The differential angularity shown in arrangements 828*a* and 828*b* may help to retain eyewear in the pocket when inserted from either direction by angling toward the insertion direction, for example. Headwear that includes separate pockets for forward and rear insertion may utilize each of the arrangements 828*c* and 828*d* for the respective pockets (e.g., 828*c* for a forward insertion pocket and 828*d* for a rear insertion pocket). In some examples, different material may be used for different angles of retaining material. For example, for a forward insertion pocket, arrangement 828*a* may be used in which angulated material to the right of the pocket are composed of slick material (having less friction or adhesive qualities than the other retaining material) to guide the eyewear into the pocket, while the angulated material to the left of the pocket is composed of more adhesive material to retain the eyewear in the pocket. In this way, the strips of retaining material may work together to increase resistance within the pocket and prevent eyewear from falling out during activity. Other arrangements of retaining material may also be utilized, including spiral, concentric circle, rectangular, and other suitable arrangements of retaining material on crown material.

Positions, orientations, types of material, textures, and/or other features of the strips of retaining material may provide for a retaining pocket that includes multiple locking positions for inserted eyewear. A wearer may select a locking position for eyewear based on a type of eyewear and/or activity being performed. For example, while reading, a wearer may not be moving his/her head extensively, however the wearer may be continually inserting, withdrawing, and reinserting eyewear. In such an example, the wearer may value ease of access of the eyewear above retention of the eyewear, and thus may select a first locking position. For example, the first locking position may correspond to the eyewear being retained and/or in face-sharing contact primarily or only by a first strip of retaining material and/or a first subset of strips of retaining material (e.g., and may not be retained or in face-sharing contact with other strips, such as strips not included in the first subset). This first strip and/or subset of strips may be configured for easy extraction/insertion of eyewear by being composed of a less resistant/tacky/adhesive material, by having a smoother texture, by having a first orientation, and/or by being positioned in a first position closer to an insertion opening (e.g., a slit) of the pocket/front of the headwear (or rear of the headwear, if the pocket is configured for insertion from a rear of the headwear, such as when the headwear is worn backward) than other strips in the pocket.

When performing activities that subject the head to frequent/intense movement and/or position the head downward (e.g., during gardening), a user may select a second locking position. For example, the first locking position may correspond to the eyewear being retained and/or in face-sharing contact primarily or only by a second strip of retaining material, a second subset of strips of retaining material, and/or a combination of the first and second strips/subsets of strips (e.g., and may not be retained or in face-sharing contact with other strips, such as strips not included in the first and/or second subset). The second strip and/or subset of strips may be configured for heavier retention of eyewear by being composed of a more resistant/tacky/adhesive material, by having a rougher/more varied texture, having a second orientation (different from the first orientation, for example), and/or by being positioned in a second position farther from an insertion opening (e.g., a slit) of the pocket/front of the headwear (or rear of the headwear, if the pocket is configured for insertion from a rear of the headwear, such as when the headwear is worn backward) than other strips in the pocket (e.g., such as the first strip and/or subset of strips).

Although only two locking positions are described herein for illustrative purposes, it is to be understood that any number of locking positions may be provided in the retaining pocket of the headwear. In some examples, the strips and/or other element in the retaining pocket may include features for providing feedback regarding successful locking in a selected position. For example, notching, stitching, and/or other elements may be provided to present a haptic and/or audible feedback upon insertion in a selected locking position. In one example, a notch near and/or within the strips for each locking position may enable a user to determine when a desired locking position is achieved by providing a haptic "snap" as the eyewear is inserted to each position (e.g., when the eyewear is inserted to a level that is deep enough to ensure retention via all strips of that locking position).

Figure 9:
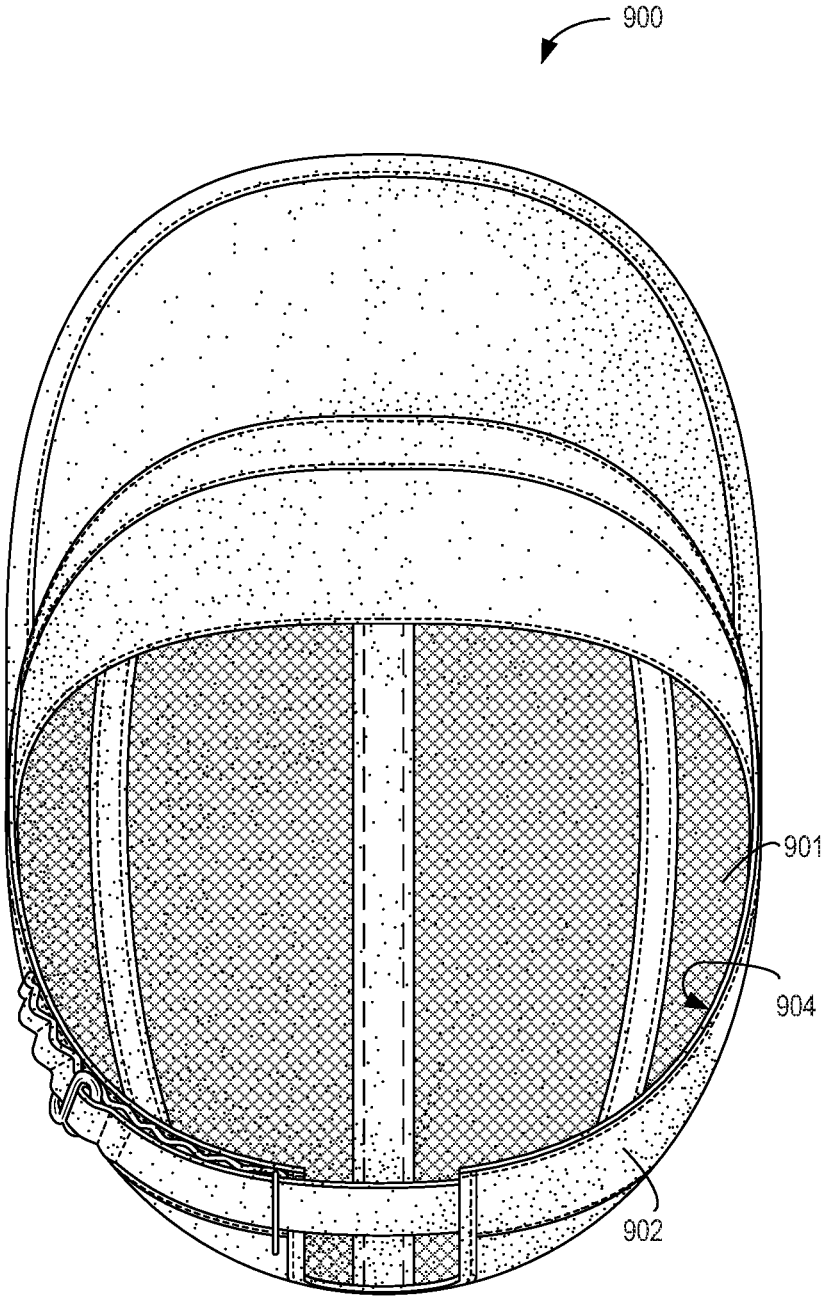
FIGS. 9 and 10 show example interior views of example headwear in accordance with one or more embodiments of the present disclosure.
Figure 10:
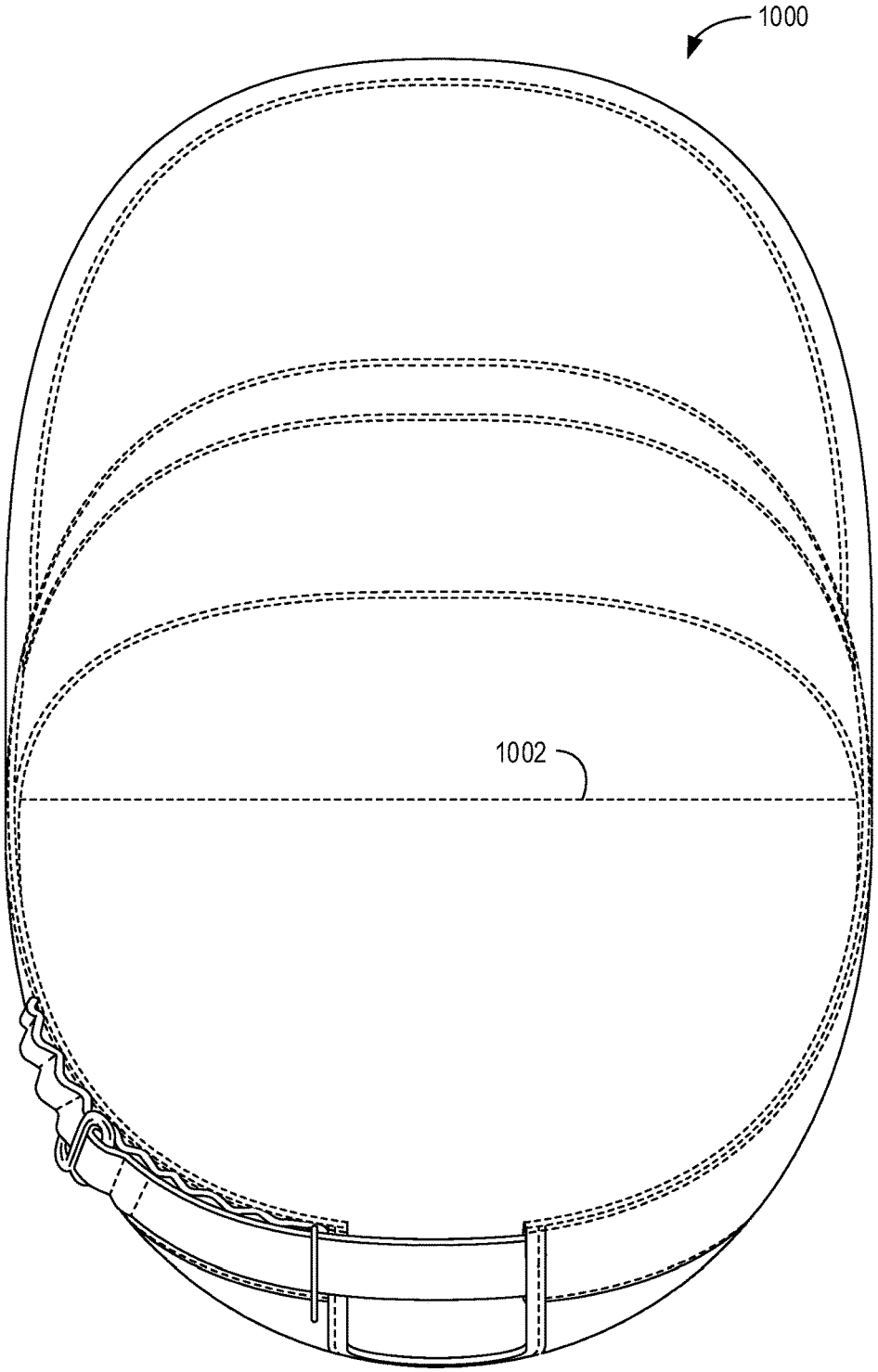

FIGS. 9 and 10 illustrate an interior of exemplary caps 900 and 1000. In some examples, either cap 900 or 1000 may correspond to headwear 100 of FIG. 1. FIG. 9 illustrates an interior comprising a porous material, such as mesh. For example, a mesh liner 901 may be configured to wick moisture and/or may be finished with durable water resistant material. An inner lining of a headband 902 may include a sweatband 904 including wicking sweatband material or other suitable material. FIG. 10 illustrates an exemplary crown pocket formed by an opening between at least two layers of material. For example, the same material used to form the outer crown region (e.g., the panels) may be used as a liner inside the cap and attached to the outer material. In other embodiments, a different material (e.g., a mesh liner 901) may be utilized to form at least one side of the crown pocket. The crown pocket may be accessed via an opening 1002 in the liner material, which may be sealable via a hook and loop enclosure or other suitable fastener. The top of the crown pocket interior may be biased with material to create a particular level of rigidity, such as the material used for the underside of the brim. In some embodiments, an edge of the crown pocket opening may overlap another edge of the crown pocket opening for additional protection of objects within the pocket.

Figure 11:
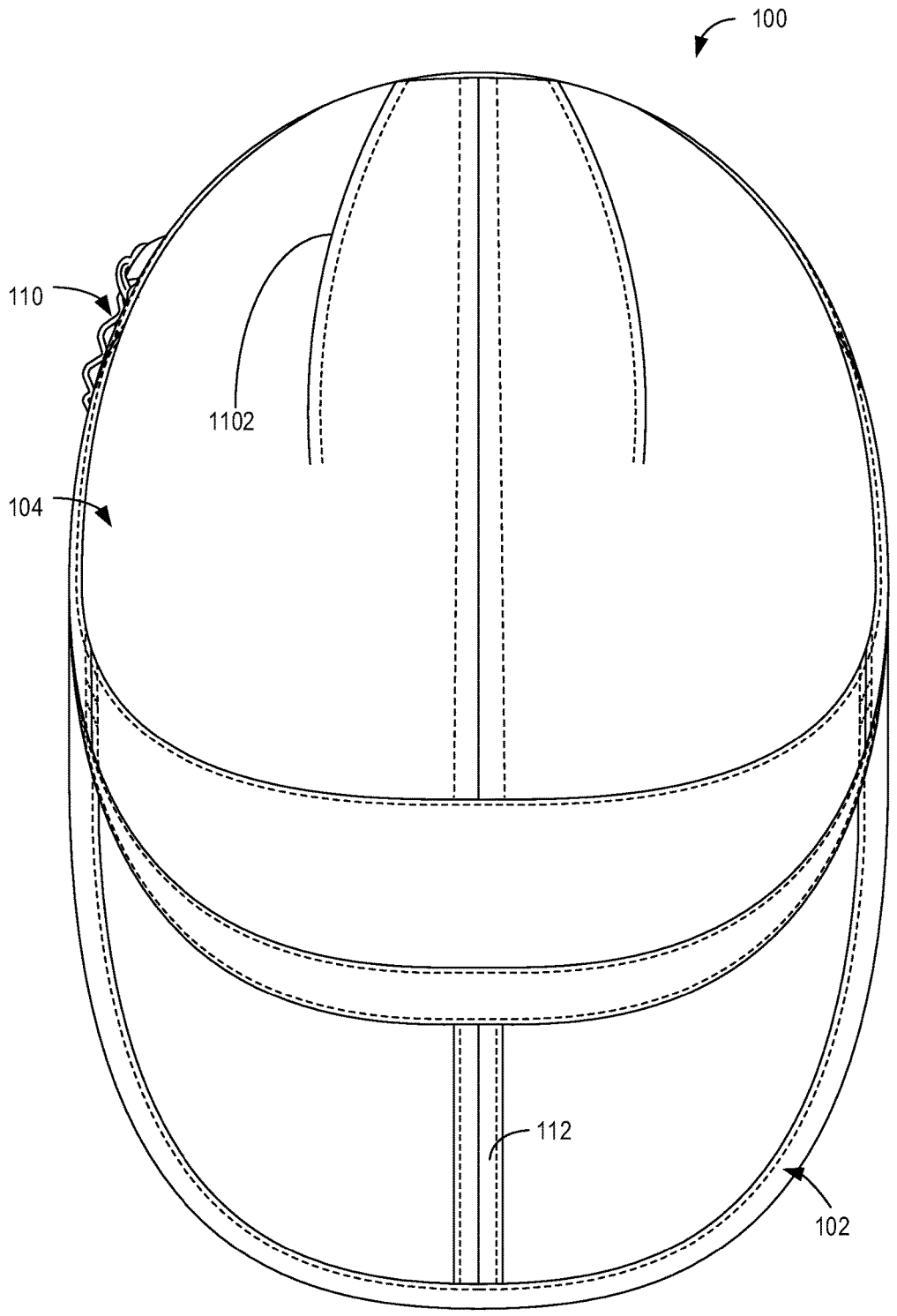
FIG. 11 shows an example top view of example headwear in accordance with one or more embodiments of the present disclosure.
Figure 12:
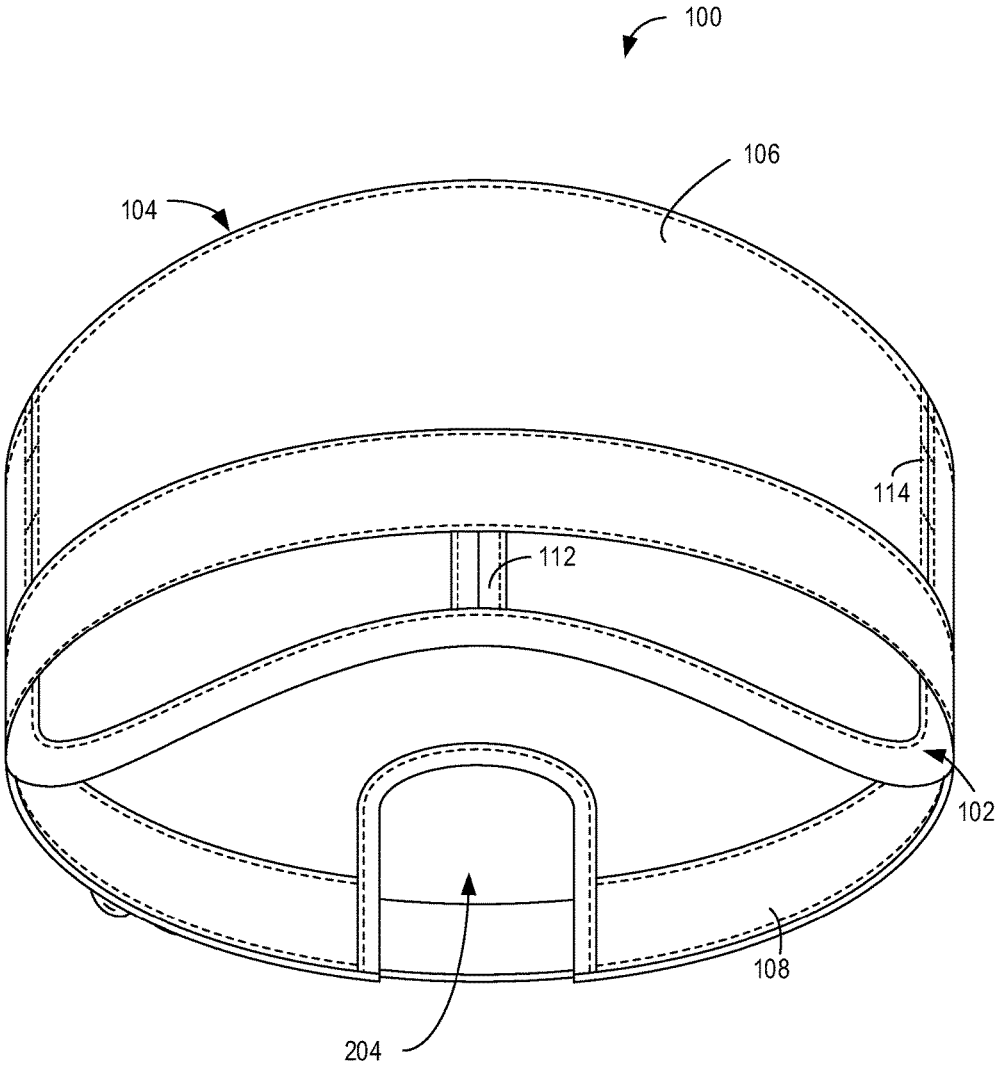
FIG. 12 shows an example front view of example headwear in accordance with one or more embodiments of the present disclosure.

FIGS. 11 and 12 show a top view and a front view of headwear 100 of FIG. 1, respectively. FIG. 11 illustrates darts 1102 that may be utilized to create crown panels having a narrower width at a rear of the cap than a front of the cap in order to provide a head-mapping crown that conforms to a shape of a wearer's head. FIGS. 11 and 12 show the brim 102, which may be a clamshell folding brim that is able to fold in half to form a substantially planar configuration for storage and portability. For example, the cap may be folded along slit 112 such that the crown may be inserted into a pocket of a jacket, trousers, or other clothing item, the brim lying flat against the clothing item. The cap may also be inserted into a pocket such that the crown and the brim are both completely housed within the pocket. It is to be understood that the reinforced folding brims described herein may be utilized in any other suitable headwear than those illustrated. For example, a full-brim hat (and/or a hat with a larger brim that that illustrated in FIG. 1) may include the reinforced folding brim described herein. Furthermore, the folding operation may be facilitated by one or more slits present in any suitable location along the brim of headwear without departing from the scope of this disclosure. The cap may also be positioned on and/or secured to one or more attachment points on an exterior of an item of clothing or an accessory, such as a coat, back pack, etc. For example, one or more fastening mechanisms of the item may be looped or tied to the guiding loop, a looped fastener, the sizing strap, and/or other regions on the cap.

Figure 13:
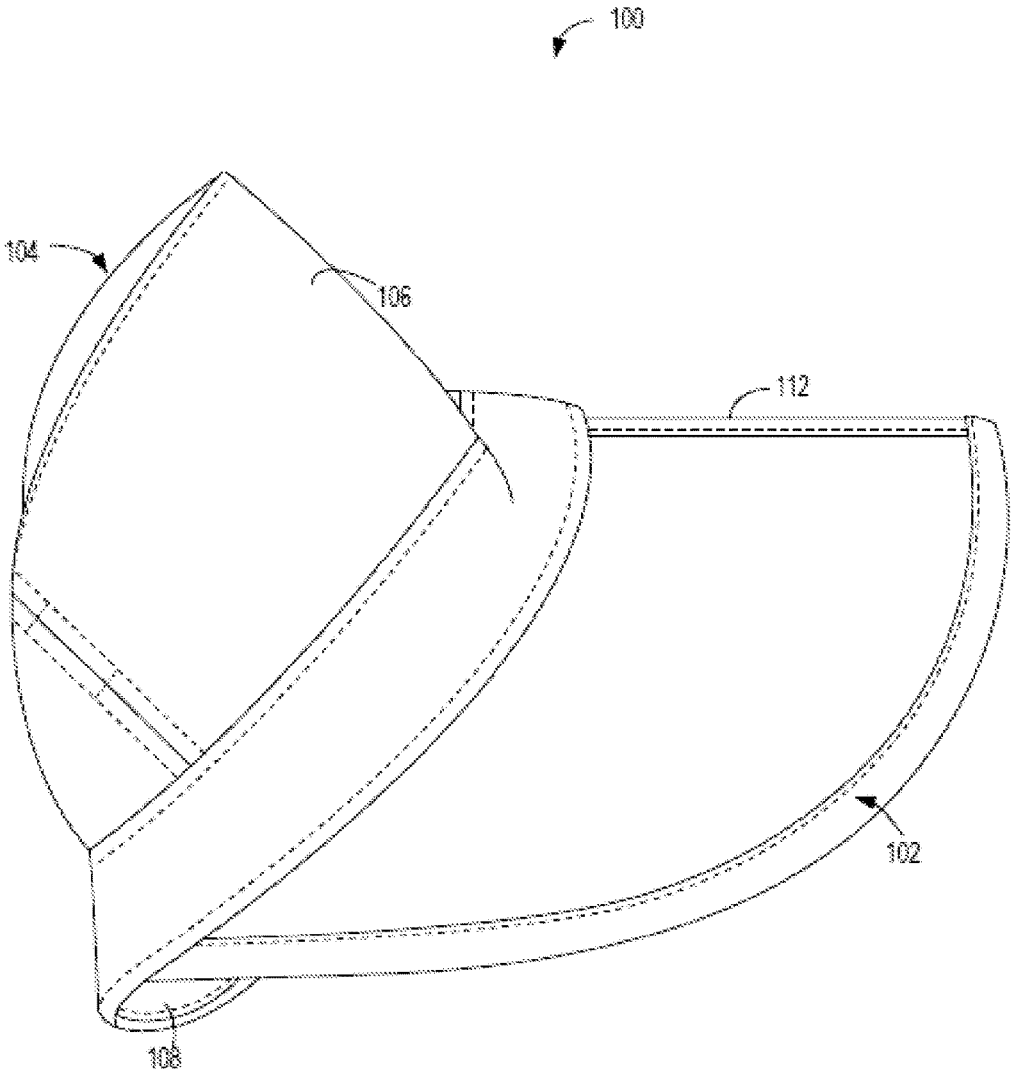
FIG. 13 shows an example folded view of example headwear in accordance with one or more embodiments of the present disclosure.

FIG. 13 shows an example folded view of the headwear 100. As discussed above with respect to FIGS. 11 and 12, the clamshell folding brim may fold along a hinge created by slit 112, bringing distal ends of the brim 102 together. Further, crown mapping darts and/or a central seam along the crown may provide additional fold points to allow the crown and/or cap to be folded and tucked away (e.g., sandwiched in between sides of the folded brim 102, to the side of/behind the folded brim 102, behind the front panel 106, etc.) while minimizing creasing or bunching of material. Similarly, the front panel 106 may include material that biases the panel to be relatively flat in a vertical direction (e.g., extending up from the headband 108 and/or brim 102) and curved around in the direction of folding (e.g., around a circumference of the cap of headwear 100). This bias may be strong enough to urge the front panel 106 to be flat in the vertical direction in order to maintain a surface for securing badges or other items, and to decrease creasing of the front panel. The bias may additionally or alternatively be wear enough to allow a wearer to flatten the front panel in a substantially horizontal direction (e.g., parallel with a longitudinal axis of the slit 112/the hinge of the folded brim) and/or otherwise tuck the front panel away (e.g., sandwiched in between sides of the folded brim 102, to the side of/behind the folded brim 102, etc.).

The example headwear described above provides many technical advantages. For example, optic holders may allow a wearer to secure protective eyewear in exterior crown slits and reduce chance of losing glasses. If the wearer is wearing the hat backward (e.g., for spotting or scope use), the reverse-facing holders may be used to still secure protective eyewear or other optics for easy access. An arrangement of retaining material in a retaining pocket may help to secure the eyewear while simultaneously allowing air to flow through the pocket and to a wearer's head.

It will be understood that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various structures and configurations, and other features, functions, acts, and/or properties disclosed herein, as well as any and all equivalents thereof.

The invention claimed is:

1. Headwear comprising: a headwear body including a crown formed of multiple layers of material including a first inner surface and a second inner surface; a hat brim extending from the crown; and one or more slits disposed on a side panel of the crown, each slit of the one or more slits penetrating at least one layer of the multiple layers of material of the crown and providing access to a pocket formed within the side panel of the crown, the pocket formed by the first inner surface coupled opposite the second inner surface, the pocket including a plurality of strips of a retaining material disposed within the pocket, each of the plurality of strips of the retaining material coupled to a same selected surface of the first and second inner surfaces as one another of the pocket; wherein the plurality of strips of the retaining material includes a first set of angulated strips of retaining material having a first frictional property to guide eyewear into the pocket, a second set of angulated strips of retaining material having a second frictional property to retain the eyewear in the pocket, and a vertical strip of retaining material between the first set and second set of angulated strips of retaining material; the first set of angulated strips of retaining material being angled relative to the second set of angulated strips of retaining material, the first set of angulated strips of retaining material and the second set of angulated strips of retaining material being angled relative to the vertical strip of retaining material, and the first frictional property having less friction or adhesive qualities than the second frictional property.

2. The headwear of claim 1, wherein the multiple layers of material of the crown include an inner ventilation lining, and wherein the same selected surface of the pocket is opposite the inner ventilation lining and stitched to the inner ventilation lining on at least two sides of the pocket.

3. The headwear of claim 1, wherein the multiple layers of material of the crown include an inner insulating material, and wherein the same selected surface of the pocket is opposite the inner insulating material and stitched to the inner insulating material on at least two sides of the pocket.

4. The headwear of claim 1, wherein at least one of the plurality of strips of the retaining material comprises a silicone material.

5. The headwear of claim 1, wherein the pocket includes a plurality of spaced regions on the same selected surface, each spaced region of the plurality of spaced regions being positioned between a different pair of adjacent strips of the plurality of strips of the retaining material.

6. The headwear of claim 1, wherein the one or more slits includes two slits providing access to opposing sides of the pocket.

7. The headwear of claim 1, wherein the headwear further comprises at least one additional slit providing access to a second pocket formed in the crown of the headwear body.

8. The headwear of claim 1, wherein the headwear body includes a plurality of panels forming a cap, the cap comprising a plurality of darts adapted to map a head of a wearer.

9. The headwear of claim 1, further comprising a size adjusting mechanism extending around a portion of a perimeter of the crown and adapted to selectively adjust a size of the crown, the size adjusting mechanism comprising a flexible strap having a rigid hook attached to one end of the flexible strap and a plurality of loops adapted to accept the hook.

10. Headwear comprising: a headwear body including a crown, the crown formed of a plurality of layers including a lining formed of ventilation material; a hat brim extending from the crown; and one or more slits disposed on a side panel of the crown, each slit penetrating at least one of the plurality of layers of the crown and providing access to a pocket formed in the side panel of the crown, the pocket including a plurality of strips of a retaining material coupled to a same inner surface of the pocket as one another, wherein the plurality of strips of the retaining material includes a first set of angulated strips of retaining material, and a second set of angulated strips of retaining material, the first set of angulated strips of retaining material being angled relative to the second set of angulated strips of retaining material, and a plurality of angled spaced regions extending between and parallel to adjacent strips of the angulated strips of the retaining material of each of the first set and the second set of angulated strips, each of the plurality of strips of the retaining material being smaller than a width of the pocket in a direction extending circumferentially around the crown, and each of the plurality of strips of the retaining material facing the ventilation material of the lining such that air flowing through the one or more slits is directed to an interior of the headwear via the ventilation material, the first set of angulated strips of retaining material having a first frictional property, the second set of angulated strips of retaining material having a second frictional property, the first frictional property having less friction or adhesive qualities than the second frictional property, and the retaining material of the second set of angulated strips comprising silicone or silicone composite material.

11. The headwear of claim 10, wherein the pocket forms a channel that is approachable from two opposing entry directions.

12. The headwear of claim 10, wherein the one or more slits includes two slits positioned on a first side of the headwear, the headwear further comprising two additional slits positioned on a second side of the headwear to provide access to a second pocket formed in a second side panel of the crown, the first side opposing the second side, and each of the two slits on a respective side of the headwear providing access to an associated pocket from a different entry direction.

13. Headwear comprising: a headwear body including a crown, the crown formed of a plurality of layers including a lining formed of ventilation material; a hat brim extending from the crown; and one or more slits disposed on a side panel of the crown, each slit penetrating at least one of the plurality of layers of the crown and providing access to a pocket formed in the side panel of the crown, the pocket including a plurality of strips of a retaining material coupled to a same inner surface of the pocket as one another, wherein the plurality of strips of the retaining material includes a first set of angulated strips of retaining material, and a second set of angulated strips of retaining material, the first set of angulated strips of retaining material being angled relative to the second set of angulated strips of retaining material, and a plurality of angled spaced regions extending between and parallel to adjacent strips of the angulated strips of the retaining material of each of the first set and the second set of angulated strips, each of the plurality of strips of the retaining material being smaller than a width of the pocket in a direction extending circumferentially around the crown, the first set of angulated strips of retaining material having a first frictional property, the second set of angulated strips of retaining material having a second frictional property, the first frictional property having less friction or adhesive qualities than the second frictional property, and the retaining material of the second set of angulated strips comprising silicone or silicone composite material.

14. The headwear of claim 13, wherein strips included in the first set of angulated strips of retaining material are parallel to one another and wherein strips included in the second set of angulated strips of retaining material are parallel to one another.

* * * * *